United States Patent [19]

Gotta et al.

[11] 4,384,900

[45] May 24, 1983

[54] METHOD OF TREATING METAL SURFACES PRIOR TO PHOSPHATIZATION

[75] Inventors: Hans Gotta, Hennef; Karl-Heinz Gottwald, Erftstadt, both of Fed. Rep. of Germany

[73] Assignee: Gerhard Collardin GmbH, Cologne, Fed. Rep. of Germany

[21] Appl. No.: 219,245

[22] Filed: Dec. 22, 1980

[30] Foreign Application Priority Data

Dec. 21, 1979 [DE] Fed. Rep. of Germany ..... 2951600

[51] Int. Cl.[3] ..... C11D 7/12; C11D 7/16; C23F 7/08; C23F 7/10

[52] U.S. Cl. ..... 148/6.15 R; 148/6.15 Z; 252/135; 252/136; 252/174.14; 252/527

[58] Field of Search ..... 134/3; 148/6.15 R, 6.15 Z; 252/109, 135, 136, 110, 174.14

[56] References Cited

U.S. PATENT DOCUMENTS

| | | | |
|---|---|---|---|
| 2,329,065 | 9/1943 | Lum | 148/6.15 Z |
| 2,345,307 | 3/1944 | Vitalis | 252/110 |
| 2,462,196 | 2/1949 | Jernstedt | 148/6.15 Z |
| 2,874,081 | 2/1959 | Cavanagh | 148/6.15 Z |
| 3,255,118 | 6/1966 | Carroll | 252/135 X |
| 3,729,346 | 4/1973 | Gotta et al. | 148/6.15 Z |
| 3,864,139 | 2/1975 | Heller | 148/6.15 Z |
| 3,888,783 | 6/1975 | Rodzewich | 252/135 |
| 4,152,176 | 5/1979 | Guhde | 148/6.15 R |

FOREIGN PATENT DOCUMENTS

| | | |
|---|---|---|
| 1170220 | 5/1964 | Fed. Rep. of Germany . |
| 2038105 | 2/1972 | Fed. Rep. of Germany . |
| 2758629 | 7/1978 | Fed. Rep. of Germany . |
| 3460 | 6/1953 | German Democratic Rep. . |
| 391421 | 9/1965 | Switzerland . |
| 743578 | 1/1956 | United Kingdom . |
| 865497 | 4/1961 | United Kingdom . |

*Primary Examiner*—Dennis L. Albrecht
*Attorney, Agent, or Firm*—Hammond & Littell, Weissenberger and Muserlian

[57] ABSTRACT

This invention is directed to a method for treating metal surfaces. More particularly, this invention is directed to an improved method for cleaning, scouring, and activating metal surfaces prior to phosphatization, which comprises contacting said metal surfaces with an aqueous solution comprising primary and/or secondary alkali metal or ammonium salts of orthophosphates and conventional metal cleaning components, the solution having a pH value of from about 6.3 to 8.2, said pH being lower than the pH value of solutions of the corresponding secondary orthophosphates alone having the same concentration; and containing optionally condensed phosphates in an amount corresponding to the amount necessary to soften the water hardness of the water used.

10 Claims, No Drawings

METHOD OF TREATING METAL SURFACES PRIOR TO PHOSPHATIZATION

FIELD OF THE INVENTION

This invention is directed to a method for treating metal surfaces. More particularly, this invention is directed to an improved method for cleaning, scouring, and activating metal surfaces prior to phosphatization.

BACKGROUND OF THE INVENTION

Methods for the formation of phosphate coats on iron and steel surfaces by means of applying acid solution containing the phosphates, that is, salts of phosphoric acid, with polyvalent metals, as well as oxidants or other accelerator components to accelerate coat formation, have been known for a long time. Dependent upon the type of application, one distinguishes between three common methods: spraying, dipping, and combination spraying-dipping methods. The use of alkaline cleaning and scouring solutions prior to phosphatization, that is, treatment with phosphates, to clean the metal surfaces to be treated of adhering oils and greases, in particular, as well as of other impurities such as metal particles, is also known. Such cleaning solutions usually contain surface-active substances, such as wetting agents, and emulsifiers, as well as so-called builder substances to increase the emulsifying-saponifying and soil carrying capacity. Examples of the latter components include sodium hydroxide, alkali metal carbonates, alkali metal orthophosphates, corresponding condensed phosphates, that is, polyphosphates, such as sodium pyrophosphate or sodium triphosphate, as well as silicates and borates. Furthermore, coat-refining and coat-activating substances have frequently been added to these cleaning and scouring agents, such as, for example, titanium phosphate. A characteristic feature of such solutions is their content of builder substances, which require a free alkalinity in aqueous solution, that is, whose alkalinity exceeds that of secondary orthophosphates, as well as a content of condensed phosphates. In typical concentrations the pH value of these cleaning solutions is between 8.5 and 11.5.

However, use of the above-described cleansers has a number of serious drawbacks with regard to subsequent phosphatization. Usually the material to be treated first passes through a rinsing zone after the cleaning zone and then is introduced into the phosphatizing zone. In spraying and combination spraying-dipping plants, the material coming to the phosphatizing zone initially comes in contact with the so-called pre-spray from the first spray ring of the phosphatizing zone. In this phase, the rinse water solution adhering to the metal surfaces, which is still contaminated with alkaline cleaning solution, is washed off by the phosphatizing solution while the formation of the phosphate coat starts at the same time. Problems arise here insofar as the pH value of the rinse water solution, which is at first in the alkaline range, successively drops on the metal surface to the acid pH value of the phosphatizing solution, passing through pH values in the range of from 6.5 to 4.5. In this slightly acidic pH range, the formation of passivating iron phosphate coats take place, and such coats impair to a considerable extent the desired coat-forming phosphatization. Additional disturbances of the coat formation also result from the use of condensed phosphates in the cleanser, since these represent strong phosphatizing toxins. Such disturbances, which are caused, on the one hand, by the alkalinity of the residual cleanser solutions and, on the other hand, by their content of condensed phosphates, manifest themselves in streaky, spotty, or passivated phosphatizing coats, whose weight fluctuates considerably. Furthermore these inhomogeneous coats provide only inadequate corrosion protection of the metal surface, particularly in connection with subsequently applied organic coats, such as electrodip coats.

The effect of the above-described negative influences of the cleaning solution on the phosphatization is greater as the velocity of flow of the material through the treatment zones is lower and the stay period of the material in the critical pre-spray zone is thus longer. However, for manufacturing reasons the velocity of flow of the material can not be increased indefinitely. The customary cleaning solutions are also extremely disadvantageous in view of the increasingly used methods with water-saving rinsing zones, for example, cascade methods, since in these methods increasing amounts of cleaning solution in the rinse water must be accepted.

OBJECTS OF THE INVENTION

It is an object of this invention to provide an improved method of cleaning metal surfaces to be phosphatized.

It is also an object of this invention to provide a method for the preliminary treatment of metal surfaces prior to phosphatization where disadvantages inherent from the use of known cleaning methods are avoided.

It is a further object of the invention to provide a method for cleaning, scouring, and activating metal surfaces to be phosphatized which comprises contacting the metal surfaces prior to phosphatization with aqueous solutions containing primary and/or secondary alkali metal or ammonium salts of orthophosphates, which comprise:

(a) a pH value in the range of from about 6.3 to 8.2, the pH value being lower than the pH value of solutions of the corresponding secondary orthophosphates alone having the same concentration; and (b) optionally, condensed phosphates in an amount corresponding to the amount necessary to soften the water hardness of water used.

These and other objects of the invention will become more apparent in the discussion below.

DETAILED DESCRIPTION OF THE INVENTION

The invention relates to a method for cleaning, scouring, and activating metal surfaces, particularly surfaces of iron and steel, as well as corresponding compound parts containing also aluminum and zinc, prior to the treatment of the latter for coat-forming phosphatization, at elevated temperatures and by means of solutions which contain primary and/or secondary alkali metal or ammonium salts of the orthophosphates, as well as known components. According to the method, the surfaces are treated with aqueous solutions of primary and/or secondary alkali metal or ammonium salts of orthophosphates which comprise:

(a) a pH value in the range of from about 6.3 to 8.2, said pH being lower than the pH value of solutions of the corresponding secondary orthophosphates alone having the same concentration; and (b) optionally, condensed phosphates in an amount corresponding to the amount necessary to soften the water hardness of the water used.

It was surprisingly found that it is possible to obtain excellent cleaning effects with the above-mentioned cleaning and scouring methods with regard to both the metal surfaces to be treated and the excellent phosphatizing coats resulting from the following phosphatization. Dependent upon the selection of the low pH range of the cleansers according to the invention, their reduced free alkalinity, and their possibly low content of condensed phosphates, the difficulties observed heretofore in the coat-forming phosphatization can be eliminated without any loss of quality in the desired cleaning result.

It is particularly preferred in the method according to the invention to treat the surfaces with solutions which have a pH value in the range of from about 6.5 to 8.0.

The cleaning solutions to be used in the method of the invention contain as building components mainly primary and/or secondary alkali metal or ammonium salts of orthophosphates, where the content of primary and/or secondary phosphate depends primarily on the pH value of the cleaning solution within the above-mentioned limits.

To adjust to the desired pH value it may be necessary to also add to the cleaning solution acid-reacting substances, such as, for example, phosphoric acid. This measure is of paramount importance, particularly in view of a possible content of other, possibly alkaline builder substances in the solutions, which would increase the free alkalinity of the cleaning solutions beyond the desired degree. Accordingly, it is preferred according to the invention to treat the surfaces with solutions whose pH value can be adjusted by the addition of phosphoric acid.

Other builder substances which may be present in the cleaning solutions—and which result in an improved cleaning effect—are, in particular, alkali metal borates, such as disodium tetraborate, and/or alkali metal bicarbonates, such as sodium bicarbonate. Thus the metal surfaces can be treated according to the invention with solutions which contain alkali metal borates and/or, at pH values of the solutions in the range of from about 7 to 8, alkali metal bicarbonates. Preferably the latter are used only in neutral or weakly alkaline solutions, since acid cleaning solutions would result in destruction of the active substances.

Condensed phosphates, for example, tetrasodium pyrophosphate and/or pentasodium triphosphate, are used as builder substances according to the invention only to the extent they are necessary to compensate the water hardness of the industrial water used for the preparation of the cleaning solution. According to a preferred embodiment of the method of the invention, the cleaning solutions used for the treatment of the metal surfaces contain no condensed phosphates. It was surprisingly found that, even without the use of condensed phosphates, water hardnesses of up to 26° dH (degrees German Hardness) are acceptable in the method according to the invention, without any adverse effects on the following phosphatization, that is, coat formation. For water hardnesses greater than 26° dH, other calcium-ion building compounds can be used for compensating the water hardness instead of condensed phosphates, which are normally used for such purposes. Suitable such calcium-ion binding compounds include hydroxypolycarboxylic acids, such as citric acid, amino-polycarboxylic acids, such as nitrilotriacetic acid or ethylenediaminetetraacetic acid, phosphonic acids, such as ethane-1-hydroxyl-1,1-diphosphonic acid or amino-trimethylene-phosphonic acid, the water soluble alkali metal salts of these acids as well as other customary sequestrants. Accordingly, it is preferred according to the invention to treat the metal surfaces with cleaning solutions which contain other calcium-ion sequestering compounds.

Other components of the cleaning solutions to be used according to the invention are commonly used anionic, cationic, or nonionic wetting agents and emulsifiers. Preferred among these are the nonionic types, for example, addition products of ethylene oxide with fatty alcohols, alkyl phenols, fatty amines, or polyoxypropylene glycols. For activating the metal surfaces to be treated, coat refiners and activators which are customary for this purpose, for example, titanium phosphate, can be added. German Published Application (DAS) No. 20 38 105 describes such an activator, which can also be used in a preferred embodiment of the method according to the invention. This activator consists substantially of titanium salt, disodium orthophosphate, and gelatin or alkali metal or ammonium salts of polyuronic acids. The cleaning solutions contain the above-mentioned components in the usual concentrations, such as, for example, from about 1 to 60 percent by weight, based on the total weight of the solution, for each compound.

The above-described cleaning solutions are generally used within the scope of the method of the invention in the manner known and customary for cleaning and scouring methods. This means that the cleaning solutions can be applied both by spraying and dipping or a combination spraying/dipping method on the metal surfaces to be treated. The temperature of the cleaning solution is usually in the range of from about 40° to about 70° C. Among the metal surfaces for which the method according to the invention can be preferably used are in particular those of iron and steel, as well as compound parts of iron and steel with aluminum and/or zinc, such as iron or steel members coated with zinc or parts that are welded or otherwise connected together, as are used, for example, in the construction of car bodies. As mentioned above, the metal surfaces are usually rinsed after cleaning and subsequently subject to a coat-forming phosphatizing process, in known manner.

The following examples are intended to illustrate the invention and are not to be construed as being limited thereto.

EXAMPLES

Example 1

Oiled iron sheet strips of deep drawing quality ST 1405 were treated for two minutes under 1.5 bar spraying pressure with a cleaning solution which had a temperature of 60° C. and contained 2.5 gm/liter of a cleaning mixture having the following composition:

56 percent by weight of $Na_2HPO_4$ 28 percent by weight of $NaH_2PO_4$ 8 percent by weight of titanium component (a mixture of titanium sulfate, disodium phosphate, gelatin and sodium carbonate prepared according to Example 1 of German Published Application No. 20 38 105)

8 percent by weight of the addition product of 13 mols of ethylene oxide on nonylphenol (NP+13 EO)

The pH value of the cleaning solution was 7.4.

Subsequently the cleaned and scoured iron sheet strips were rinsed with a rinse water containing 0.07 gm/liter of the cleaning mixture, corresponding to 3 liter/$m^2$ fresh water supply, and then were introduced into the phosphatizing zone at a rate of 1 m/min. The iron sheet strips were phosphatized by spraying a phosphatizing solution for three minutes at a spraying pressure of 0.8 bar and at a bath temperature of 65° C., the phosphatizing solution containing 3 percent by weight of a concentrate of the following composition:

10 percent by weight of ZnO
24 percent by weight of $H_3PO_4$
6 percent by weight of $HNO_3$
balance water The ratio of total acid to free acid in the phosphatizing solution was adjusted to a value of 10 by the addition of dilute soda lye, and a nitrite concentration of 0.015 percent by weight was maintained by the addition of sodium nitrite.

Subsequently the sheets were rinsed thoroughly with deionized water and dried, and an optical evaluation of the phosphatizing coat was then made. The formation of the coat proved quite satisfactory, that is, the coat was continuous and homogeneous.

Unless noted otherwise, the following examples proceeded according to the procedure and data set forth in Example 1. These examples differ from Example 1 in the composition of the cleaning solution used and, as can be seen from the attached composition examples, in the formation of the phosphatizing coat.

Example 2

Composition of the cleaning mixture:
34 percent by weight of $NaH_2PO_4$
50 percent by weight of $Na_2B_4O_7.10\ H_2O$
8 percent by weight of titanium component
8 percent by weight of NP+13 EO The pH value of the cleaning solution was 7.8.

Formation of the phosphatizing coat was excellent. The coating was extremely homogeneous, continuous, and hard.

Example 3

Composition of the cleaning mixture:
36 percent by weight of $Na_2HPO_4$
40 percent by weight of $NaH_2PO_4$
8 percent by weight of $Na_2H_2P_2O_7$
8 percent by weight of titanium component
8 percent by weight of NP+13 EO The pH value of the cleaning solution was 6.7.

The formation of the phosphatizing coat was excellent. The coating was extremely homogeneous, continuous, and hard.

Example 4

Composition of the cleaning mixture:
42 percent by weight of $Na_2HPO_4$
36 percent by weight of $NaH_2PO_4$
6 percent by weight of citric acid
8 percent by weight of titanium component
8 percent by weight of NP+13 EO The pH value of the cleaning solution was 6.5.

The formation of the phosphatizing coat was excellent. The coating was extremely homogeneous, continuous, and hard.

Example 5—(Comparison)

Composition of the cleaning mixture:
66 percent by weight of $Na_2HPO_4$
18 percent by weight of $Na_4P_2O_7$
8 percent by weight of titanium component
8 percent by weight of NP+13 EO The pH value of the cleaning solution was 9.0.

The phosphatizing coat formed was poor, that is, it was unhomogeneous and broken up into islets, and part of the coating was blue passivation coating, representing iron phosphate.

Example 6—(Comparison)

Composition of the cleaning mixture:
26 percent by weight of $Na_3PO_4$
30 percent by weight of $Na_2HPO_4$
12 percent by weight of $Na_5P_3O_{10}$
16 percent by weight of $Na_2CO_3$
8 percent by weight of titanium component
8 percent by weight of NP+13 EO The pH value of cleaning solution was 11.0.

Formation of phosphatizing coat was poor. The coating was nonhomogeneous and had the streaky appearance of blue passivation coats (iron phosphate coats).

The preceding specific embodiments are illustrative of the practice of the invention. It is to be understood, however, other expedients known to those skilled in the art or disclosed herein, may be employed without departing from the spirit of the invention or the scope of the appended claims.

We claim:

1. In a method for phosphatizing metal surfaces wherein dirty metal surfaces are cleaned and scoured with a cleanser and then acid solution containing phosphates is applied to the cleaned and scoured metal surfaces to form phosphate coatings, the improvement which comprises cleaning, scouring, and activating the metal surfaces in one step with an aqueous solution comprising (a) primary and/or secondary alkali metal or ammonium salts of orthophosphates; (b) from about 1 to 60 percent by weight, based upon the total weight of the solution, of alkali metal borates; (c) conventional metal cleansing components; and (d) optionally condensed phosphates in an amount corresponding to the amount necessary to soften the water hardness of the water used, the solution having a pH value in the range of from about 6.3 to 8.2, said pH value being lower than the pH value of solutions of the corresponding secondary orthophosphates alone having the same concentration.

2. The method of claim 1, wherein the solution has a pH value of from about 6.5 to 8.0.

3. The method of claim 1, wherein the pH value of the solution is adjusted by addition of phosphoric acid.

4. The method of claim 1, wherein the metal surfaces are iron or steel surfaces.

5. The method of claim 1, wherein the metal surfaces are the surfaces of iron or steel in combination with aluminum and/or zinc.

6. The method of claim 1, wherein the metal surfaces comprise zinc-coated iron or steel.

7. The method of claim 1, wherein the solution contains alkali metal bicarbonates at a pH value of from about 7 to 8.

8. The method of claim 7, wherein the alkali metal bicarbonates are present in an amount of from about 1 to 60 percent by weight, based upon the total weight of the solution.

9. The method of claim 1, wherein the solution contains other calcium-ion sequestering compounds.

10. The method of claim 9, wherein the other calcium-ion sequestering compounds are present in an amount of from about 1 to 60 percent by weight, based upon the total weight of the solution.

* * * * *